US006375524B1

(12) United States Patent
Commandeur et al.

(10) Patent No.: US 6,375,524 B1
(45) Date of Patent: Apr. 23, 2002

(54) VESSEL COMPRISING A RETRACTABLE THRUSTER

(75) Inventors: Johan Albert Commandeur; Wilhelmus Coenradus Johannes Jozephus Woldring, both of Schiedam (NL)

(73) Assignee: IHC Gusto Engineering B.V., Schiedam (NL)

( * ) Notice: Subject to any disclaimer, the term of this patent is extended or adjusted under 35 U.S.C. 154(b) by 0 days.

(21) Appl. No.: 09/529,981

(22) PCT Filed: Oct. 23, 1998

(86) PCT No.: PCT/NL98/00610

§ 371 Date: May 10, 2000

§ 102(e) Date: May 10, 2000

(87) PCT Pub. No.: WO99/20524

PCT Pub. Date: Apr. 29, 1999

(30) Foreign Application Priority Data

Oct. 23, 1997 (EP) ..... 97203284

(51) Int. Cl.[7] ..... B63H 5/125
(52) U.S. Cl. ..... 440/54; 440/60; 440/61
(58) Field of Search ..... 440/54, 53, 61, 440/60, 58; 114/151

(56) References Cited

U.S. PATENT DOCUMENTS

| | | | |
|---|---|---|---|
| 2,479,119 A | | 8/1949 | Johnson |
| 2,638,863 A | * | 5/1953 | Kiebler et al. |

FOREIGN PATENT DOCUMENTS

| | | | |
|---|---|---|---|
| DE | 1 079 493 | | 3/1958 |
| EP | 0 613 817 | | 9/1994 |
| FR | 2 560 147 | | 8/1985 |
| GB | 1 561 006 | | 2/1980 |
| JP | 12-142583 | * | 5/2000 |

* cited by examiner

*Primary Examiner*—Sherman Basinger
(74) *Attorney, Agent, or Firm*—Young & Thompson

(57) ABSTRACT

A retractable thruster (5) is connected to a lifting device for retracting the thruster in two stages, the lifting device in the first stage lifting the thruster to a level at or near the keel (7) of the vessel, the second stage including lifting the thruster to an access level (13), located above the first level. The lifting device may be formed by a rack (3,3') which can be constructed on deck level, or by hydraulic cylinders. Preferably the frame (6) which carries the thruster is formed by a closed container having buoyancy, the drive motor, gearbox and rotational drive unit being placed in the container.

13 Claims, 12 Drawing Sheets

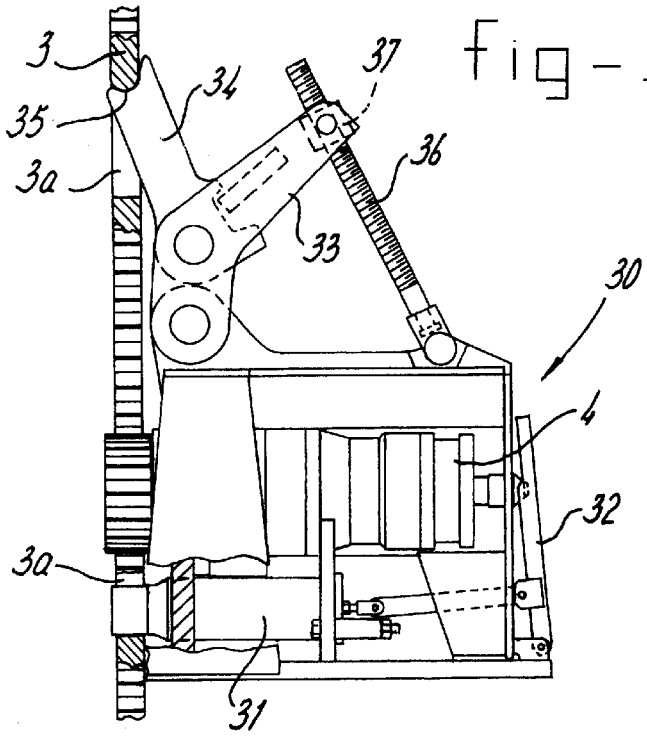
fig-11
fig-12
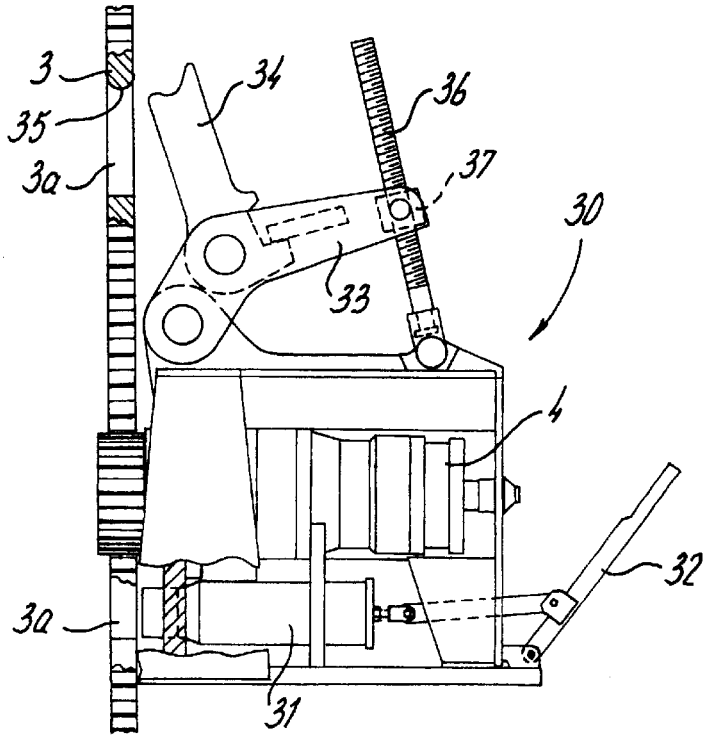

VESSEL COMPRISING A RETRACTABLE THRUSTER

BACKGROUND OF THE INVENTION

The invention relates to a vessel provided with a retractable thruster that is mounted in a frame which is displaceable in a shaft in the hull of the vessel, which frame is connected to a lifting device for retracting the thruster in two stages, the lifting device in the first stage lifting the thruster to a level at or near the keel of the vessel, the second stage comprising lifting the thruster to an access level, located above the first level.

Vessels with retractable thrusters are known, wherein one or more thrusters can be extended up to about 4 metres below keel level of the vessel. These thrusters are often used for dynamic positioning purposes and for maintaining the vessel in a fixed orientation with respect to prevailing wave and current directions. However, while sailing to a working location or while entering a harbour, the positioning thrusters are retracted flush with keel level of the vessel in order to decrease the water resistance and to not interfere with the sea bed in shallow waters.

The known retractable thrusters are relatively difficult to inspect and to maintain as maintenance can only be carried out in a dry dock or by means of divers. Furthermore, the known thrusters, which may comprise an integrated containerised unit having a drive control unit, a propeller, cooling etc., take a long time to install and can only be mounted with relative difficulty.

From FR-A-2 560 147 a vessel having a retractable thruster is known. In the known construction, the thruster drive motor is mounted in a tank which comprises a rack which can be lifted by means of pinions on the vessel. The pinions are mounted in a movable frame which can be locked in different positions on a lifting structure mounted on deck level for staged retraction of the thruster.

In an alternative embodiment, the rack and pinions are replaced by a hydraulic cylinder (FIG. 11) mounted on the movable frame.

The known thruster can be retracted in two stages, the lifting device in the first stage lifting the thruster to a level at or near the keel of the vessel, the second stage comprising lifting the thruster to an access level, located above the first level. By mounting the thruster for instance through a hole in the vessel (moonpool-like), the thruster can be retracted in the first stage to be flush with the hull of the vessel for purposes of entering shallow waters or for sailing the vessel at high speed. In case maintenance is necessary, the thruster is lifted to the second level for easy access via for instance a tween deck. By mounting the thruster, that is preferably connected to a frame or container, in a hole (moonpool-like) in the vessel, a relatively simple construction is obtained wherein the thruster can be put in position when the vessel is already afloat. Hereby relatively short construction times can be achieved.

The known lifting device has as a disadvantage that a relatively large lifting structure is permanently mounted on deck level, which may during offshore operations form an obstacle for equipment placed on deck level. In the first stage of retraction of the thruster, a large part of the lifting device that is connected to the frame extends above deck level.

SUMMARY OF THE INVENTION

It is therefore a purpose of the present invention to provide for a relatively compact retractable thruster that can be easily installed and on which maintenance can be carried out in an easy manner, the lifting device in the first stage of retraction occupying relatively little space on the deck of the vessel. It is a further object of the present invention to provide a compact system that is of simple design and that is particularly suited for conversion of existing vessels to vessels comprising one or more thrusters for dynamic positioning purposes.

Thereto, according to one embodiment of the present invention, the shaft of the vessel is provided with a rack. The frame comprises a pinion movable along the rack, wherein in the second stage, the rack can be extended by means of a separate rack extension means which is attachable to the rack. By means of for instance a double-toothed rack which is connected to the vessel and by pinions connected to the thruster frame, the thruster can be retracted to keel level without any significant structure projecting along deck level. For maintenance purposes, the rack extension means is temporarily connected to the main deck so that the track for the pinions is extended and the thruster can be displaced along the second stage up to the level of a tween deck. A temporary workfloor can be constructed across the shaft in the vessel wherein the thruster can be displaced for access of a maintenance crew to the thruster.

In an alternative embodiment, the lifting device may be comprised of hydraulic cylinders that are placed below deck level at a fixed position. The frame of the thruster is detachably coupled to the lifting device, or cylinders. The thruster can be lifted to the first stage at for instance a full stroke of the cylinders, and thereafter be decoupled therefrom. Then the cylinders are again fully extended and connected to the frame at a lower position. Upon retraction of the cylinders in the second stage, the thruster can be further retracted into the shaft of the vessel, whereby the fame may come to extend above the main deck. Again, the cylinders occupy relatively little deck space on the vessel.

BRIEF DESCRIPTION OF THE DRAWINGS

The invention will be explained in detail with reference to the accompanying drawings. In the drawings:

FIGS. 11 and 12 show the locking mechanism for the frame in the locked and unlocked position, respectively.

DESCRIPTION OF THE PREFERRED EMBODIMENTS

Figure 1:
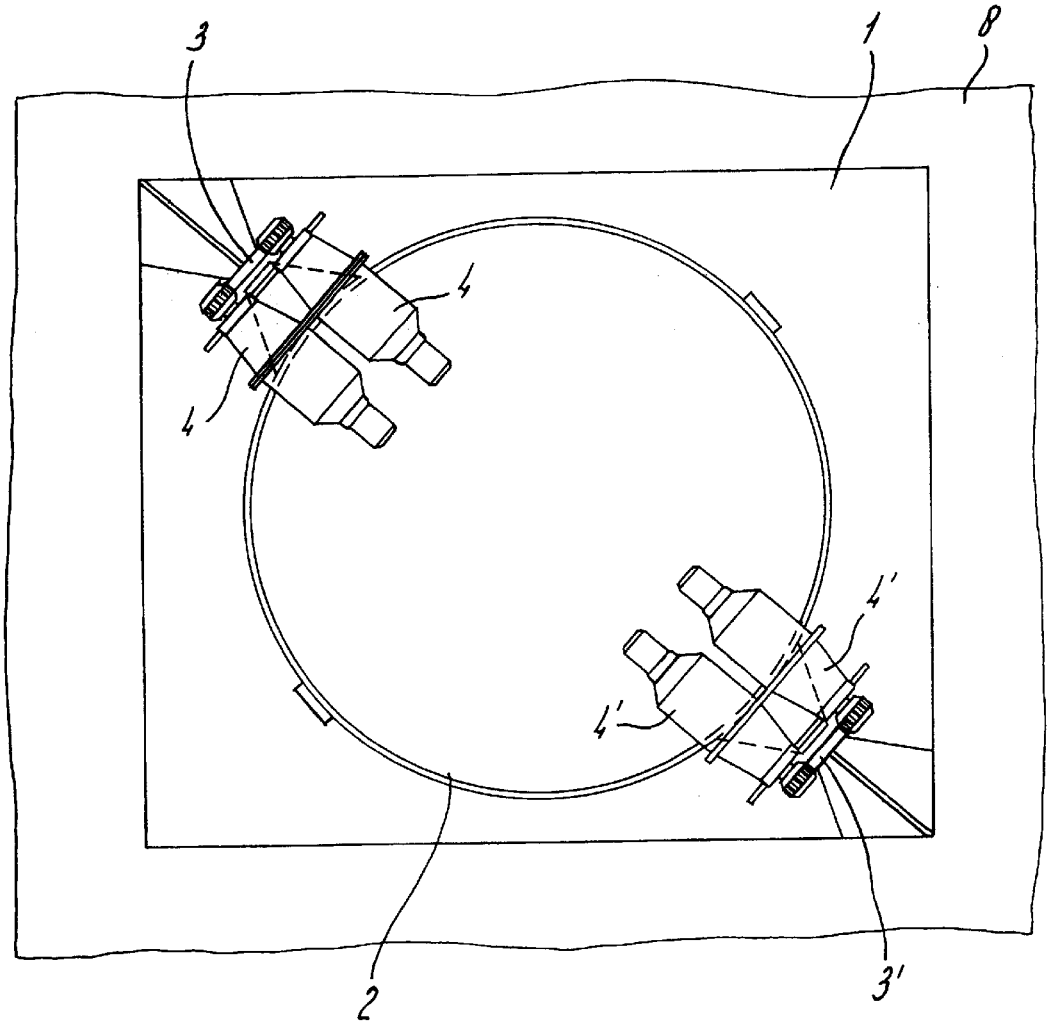
FIG. 1 shows a top view of a moonpool according to the invention wherein a container or frame comprising a thruster may be mounted.

FIG. 1 shows a top view of a deck 1 of a vessel comprising a shaft or moonpool 2 in which a thruster can be placed. Along two double-toothed racks 3,3', two sets 4,4' of each four electrically driven pinion drives can be vertically displaced.

Figure 2:
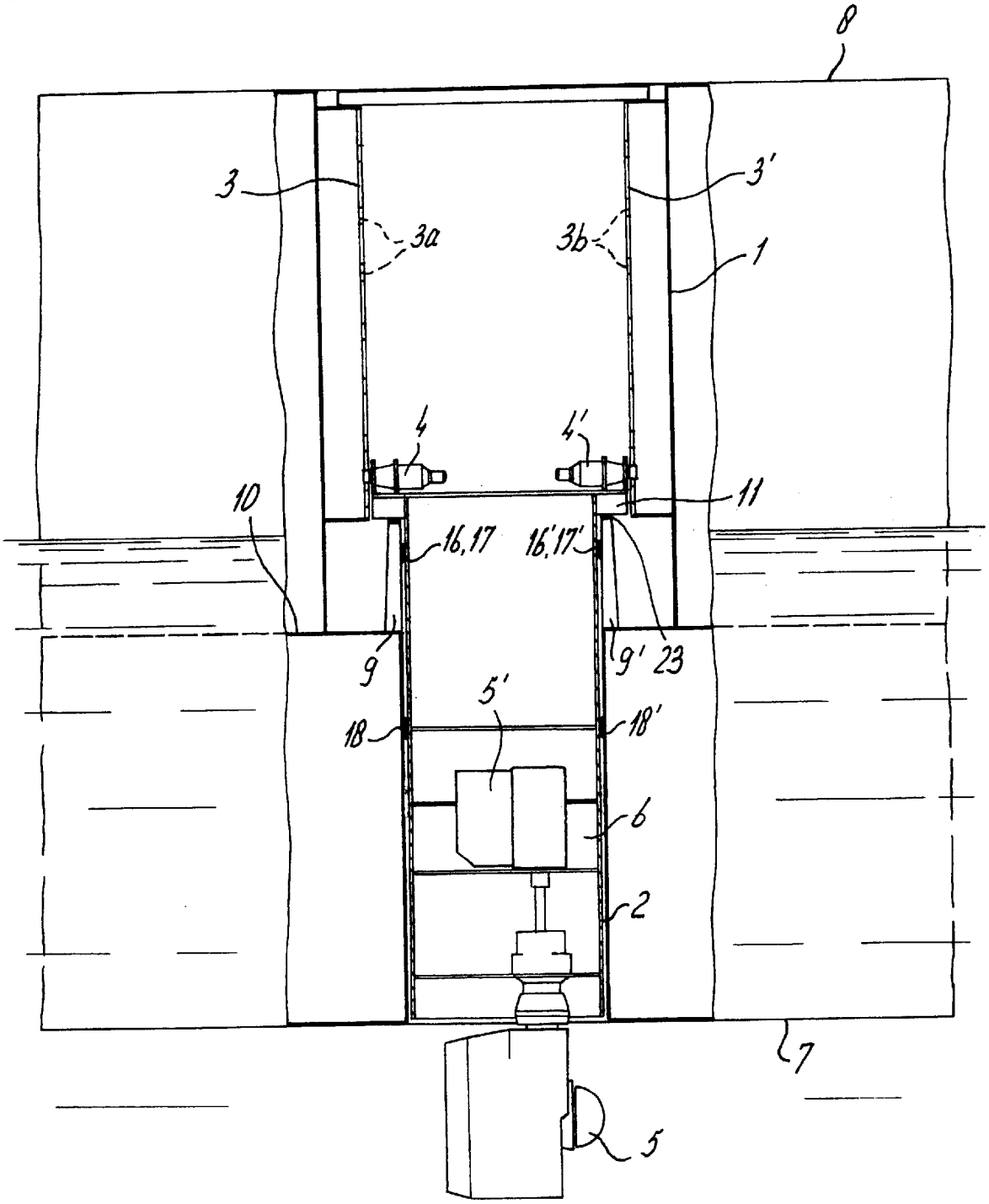
FIG. 2 shows the first embodiment of a retractable thruster comprising a rack and pinion in the working position.

As shown in FIG. 2, the thruster 5, as well as its drive motor, gear mechanism and rotational drive Unit 5' are connected to a frame 6. In FIG. 2, the thruster 5 extends below keel level 7, The pinion drives 4,4' are connected to the top pan of the frame 6, A locking device, as is shown in FIG. 11, is incorporated at the top end of the frame is 6, preferably integrated with the pinon drives 4,4', for fixing the frame 6 in a play-free position with respect to the vessel. Hereto the racks 3,3' are at regular positions provided with holes 3*a*, 3*b*, into which a locking pin of the locking device may be inserted.

Figure 5:
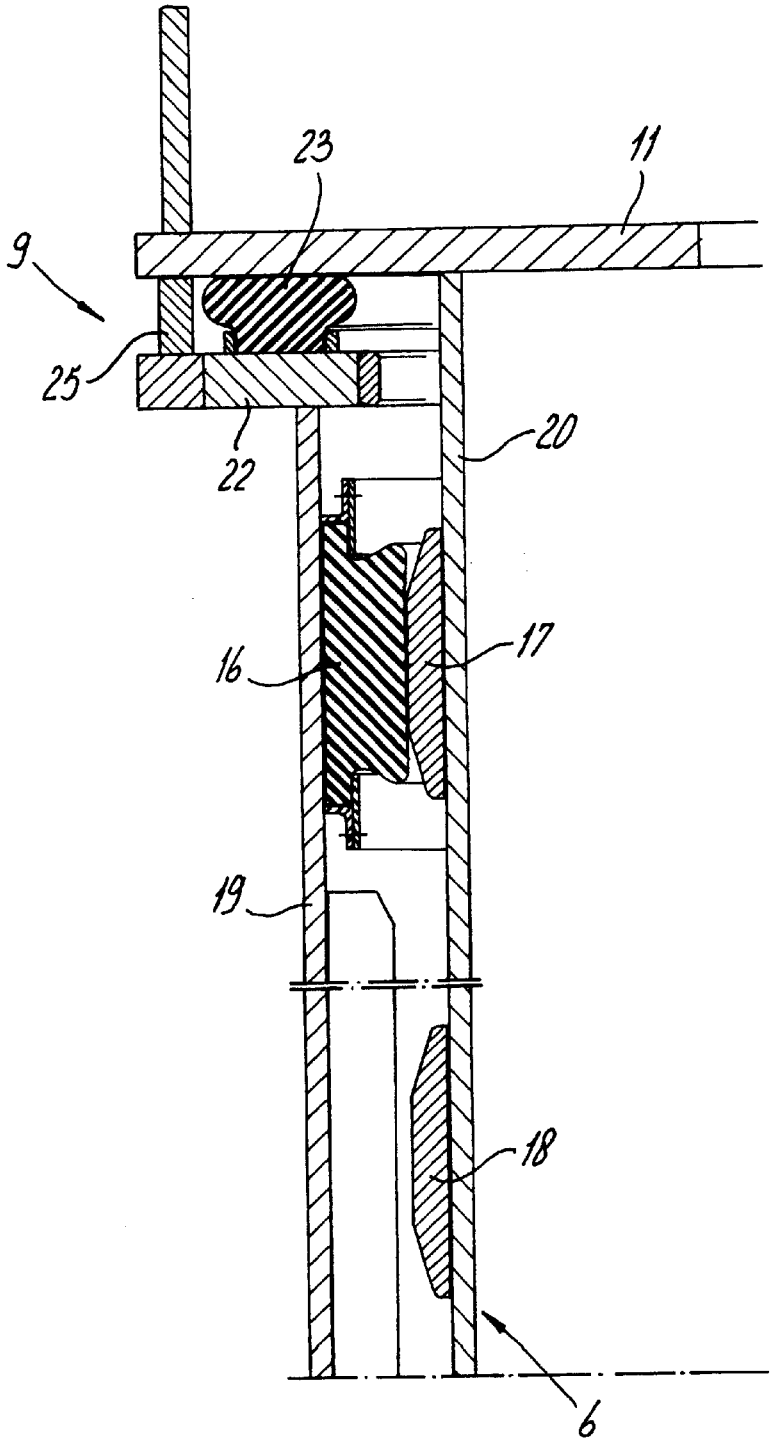
FIG. 5 shows the sealing arrangement of the frame on an enlarged scale.

The racks 3,3' extend up to deck level 8. In the working position, the frame 6 is in its lowest position with respect to the shaft and is supported on support members 9,9' connected to the tween deck 10. The upper part of the frame 6 has a radially extending support ring 11 for co-operating with the support members 9,9'. An axial seal 23, as shown in more detail in FIG. 5, is comprised between the support members 9,9' and the support ring 11. The inner wall of the shaft 2 is near the upper part provided with radial seals 16, 16'. The frame 6 comprises at the position corresponding to the position of the radial seals 16, 16' in FIG. 2, two upper radial sealing projections 17,17', and two lower radial sealing projections 18,18'. These radial sealing projections are shown in more detail in FIG. 5. When the frame 6 is retracted upwardly, the lower radial sealing projections 18,18' are brought into engagement with the seals 16, 16', while the upper radial sealing projections 17, 17' are moved upward, as shown in FIG. 3.

Figure 3:
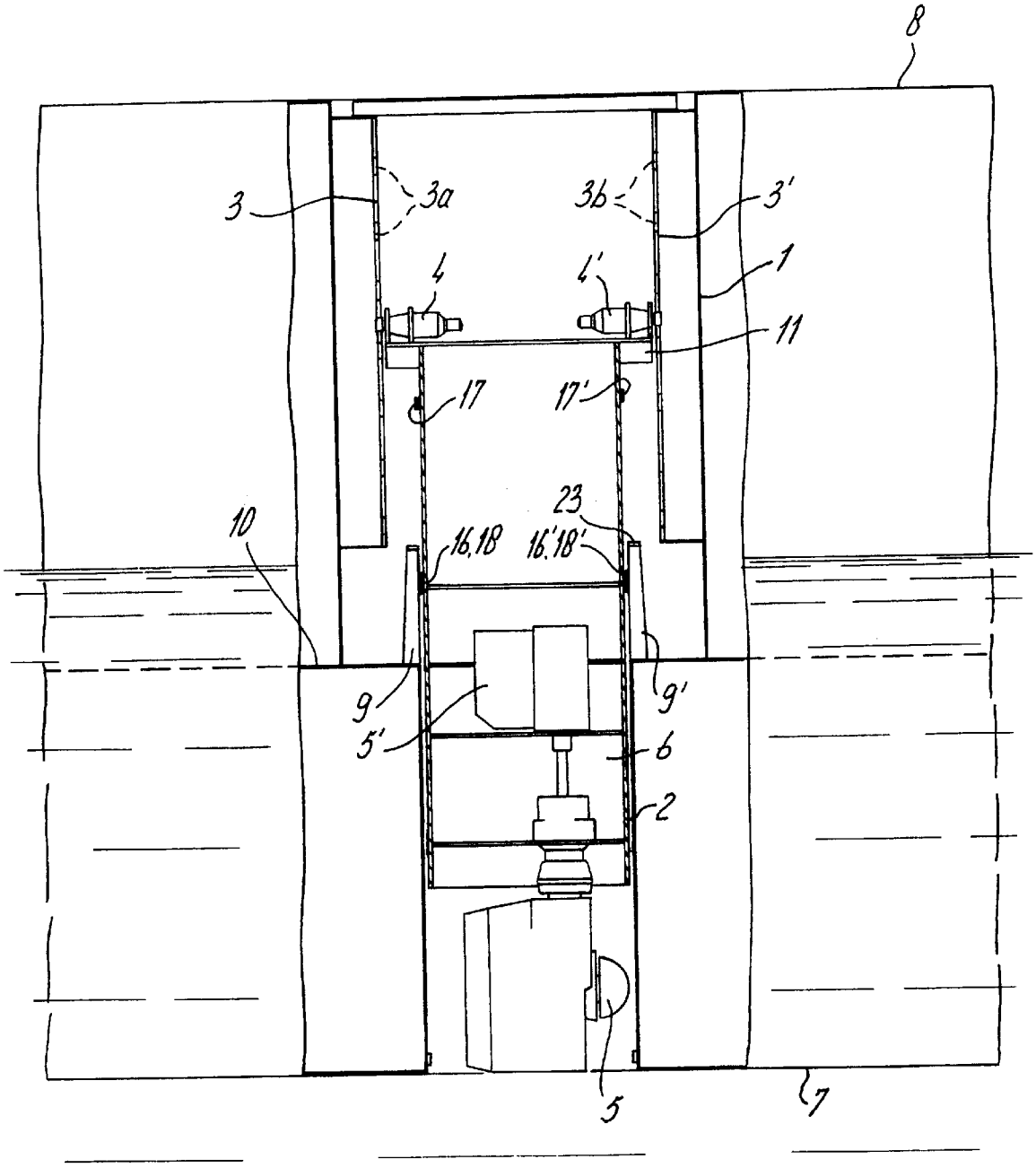
FIG. 3 shows the thruster according to FIG. 2 in the first stage of retraction.

FIG. 3 shows the vertical displacement of the pinion drives 4,4' along the rack 3,3' to retract the thruster 5 to the first stage wherein the thruster is flush with keel level 7.

Figure 4:
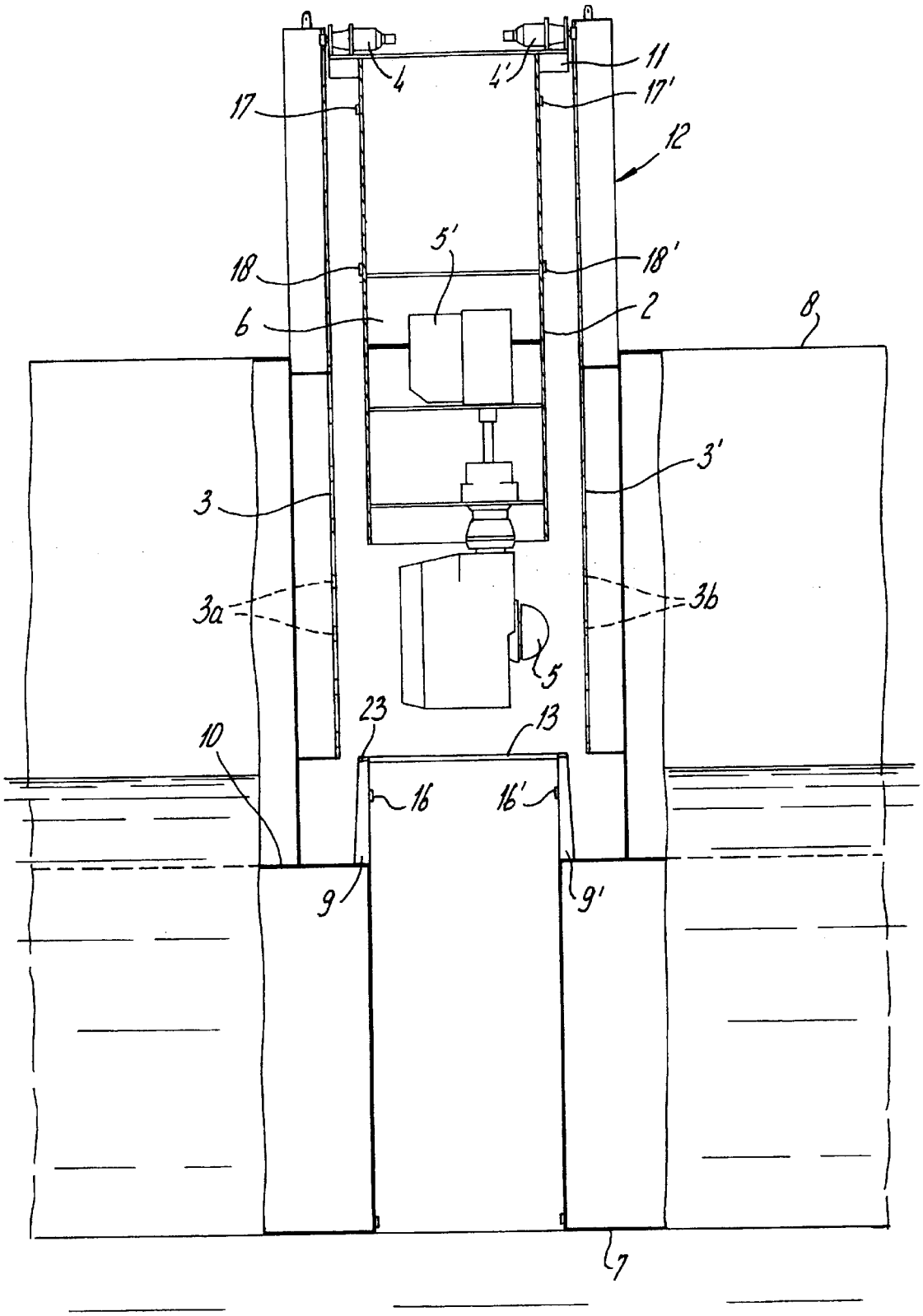
FIG. 4 shows the thruster according to FIG. 2 in the second stage of retraction.

FIG. 4 shows a temporary rack extension means 12 connected to the racks 3,3' for displacing the thruster 5 to a maintenance or inspection position. In this position a temporary workfloor 13 can be positioned on the support members 9 for allowing access to the thruster 5 by a maintenance crew, FIG. 5 shows in more detail the construction of the axial seal 23 which is connected to a support surface 22 of the support member 9. In the lowest position of the frame 6, wherein the thruster 5 is placed below keel level, the support ring 11 rests on the rim of the support surface 22 and compresses the axial seal 23, such that water is prevented from entering via the space between the shaft wall 19 and the frame wall 20. Preferably, the frame 6 is formed by a closed container having buoyancy. On the shaft wall 19, the radial sealing element 16 is comprised, which is compressed by the upper radial projection 17 on the frame wall 20, When the frame 6 is retracted upwardly, the slanting surfaces of the projection 17 slide past the sealing element 16, which expands radially outwardly when no longer radially restricted by the protrusion 17. In its expanded state, the scaling element 16 is provided with slanting surfaces, such the lower projection 18 can be slid into engagement with the sealing element 16 upon moving the frame 6 further upward, until the sealing element 16 is again fully compressed by the lower projection 18.

Figure 6:
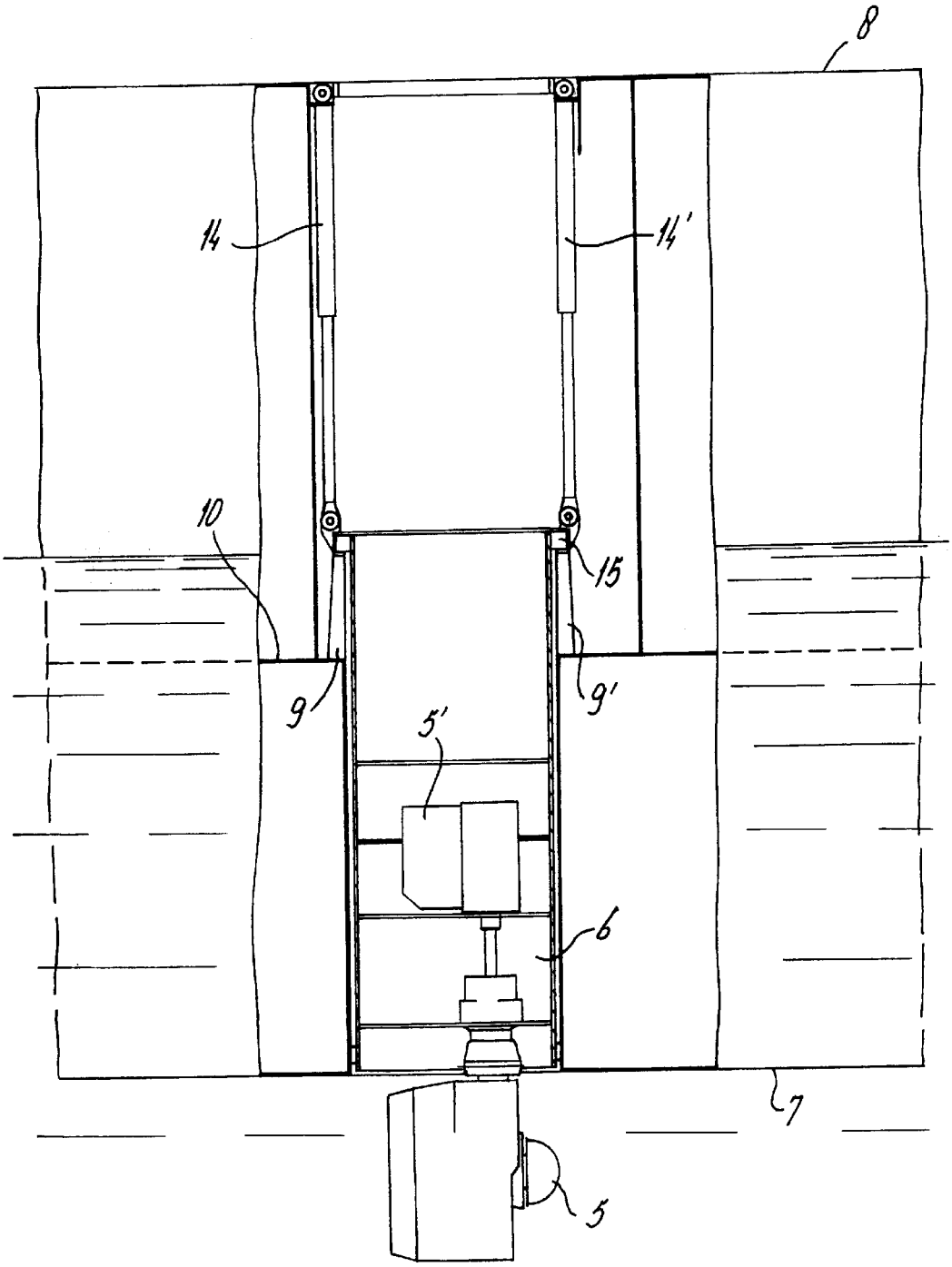
FIG. 6 shows a retractable thruster comprising hydraulic lifting means in the working position.
Figure 7:
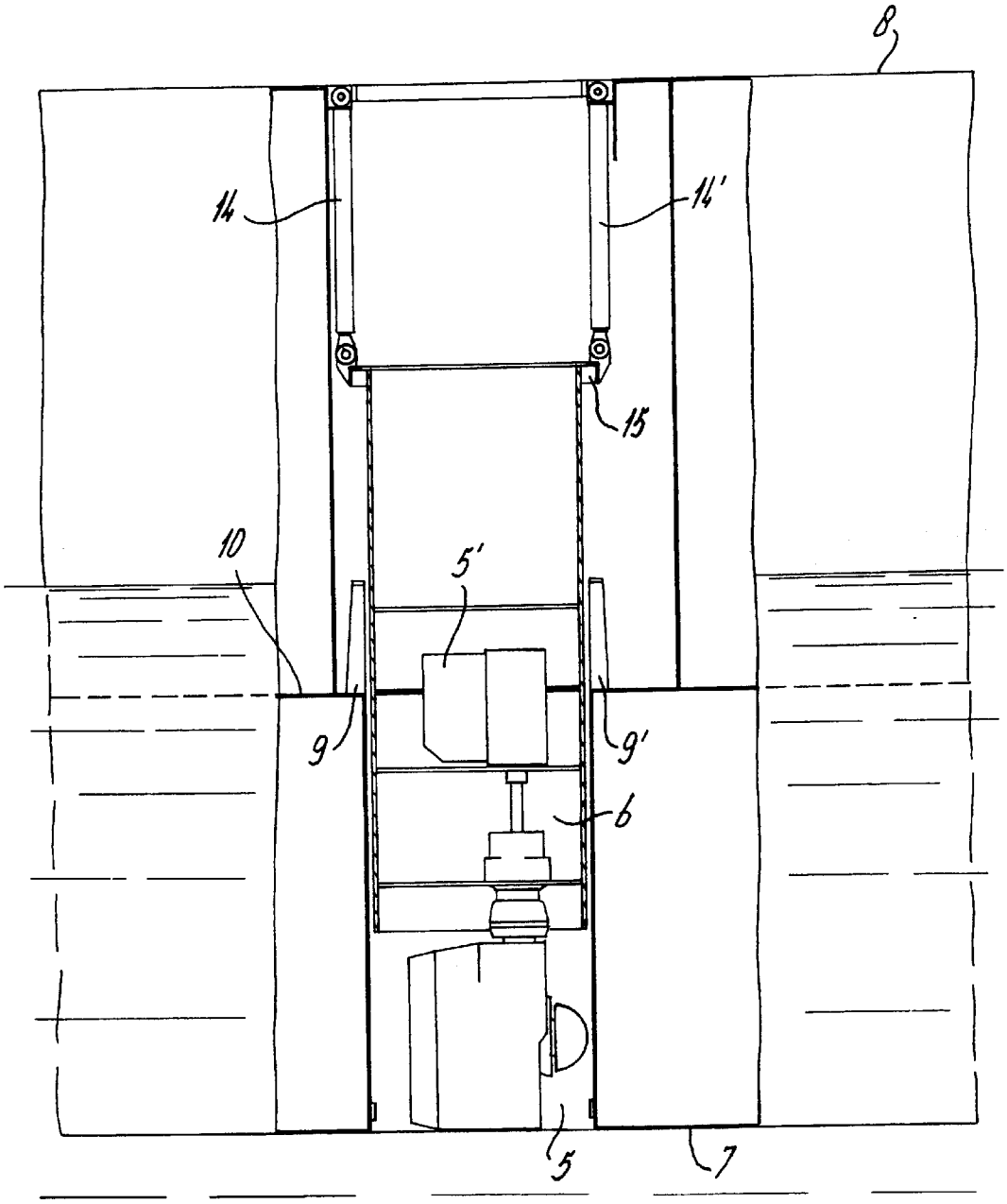
FIG. 7 shows the thruster of FIG. 6 in the first stage of retraction.
Figure 8:
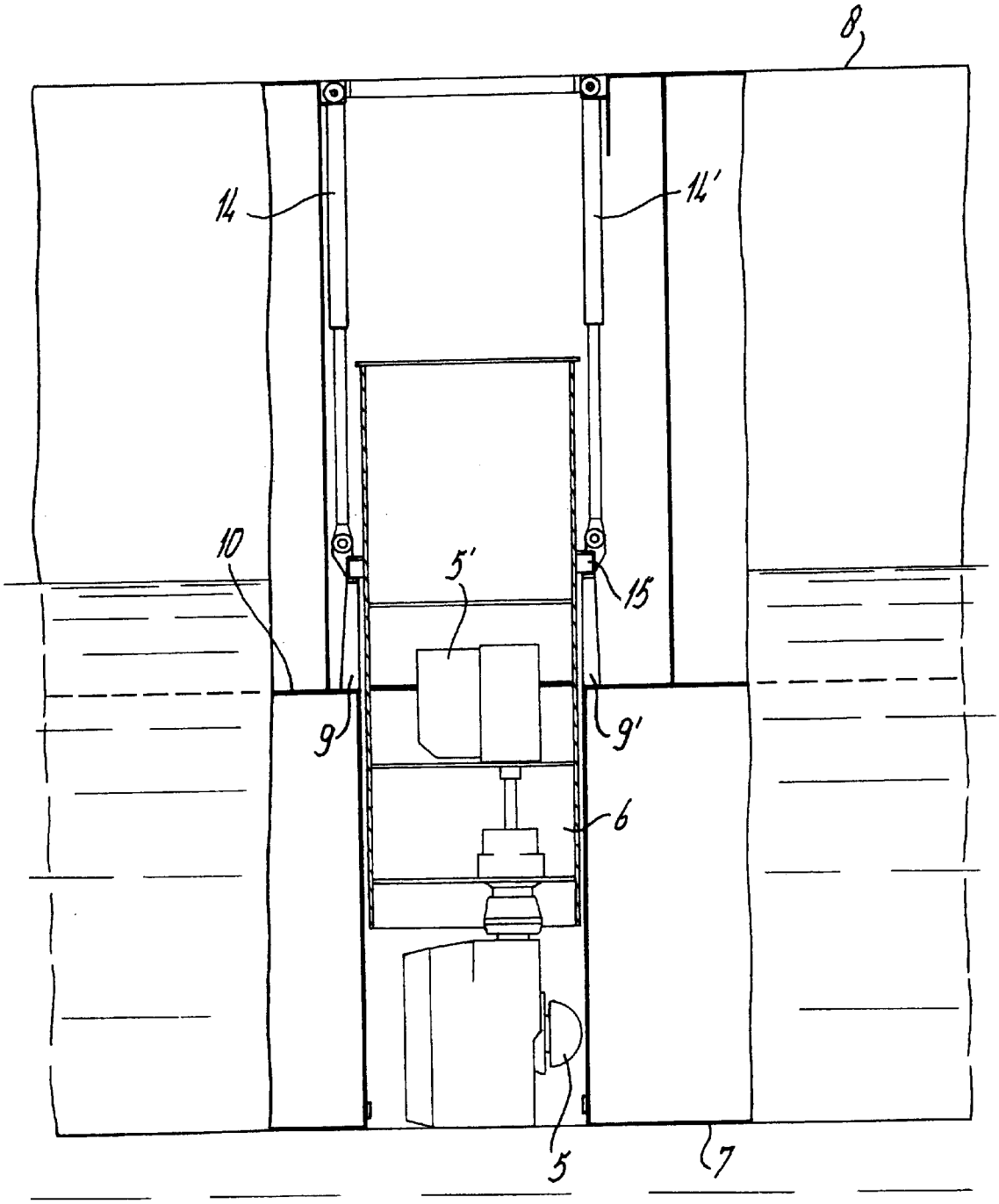
FIG. 8 shows a displacement of the coupling ring along the frame of the thruster.
Figure 9:
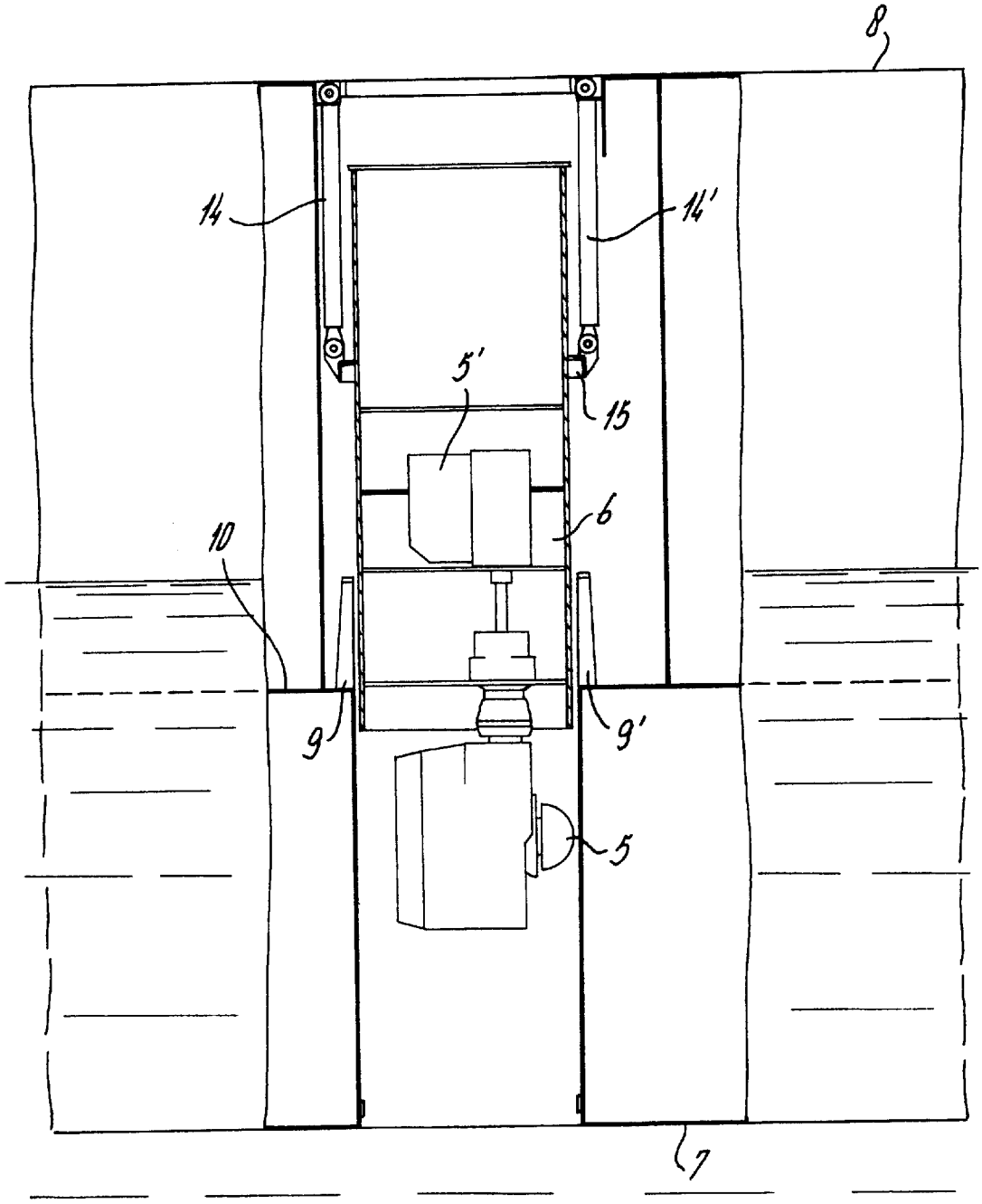
FIG. 9 shows the thrust according to FIG. 6 in a further retracted position
Figure 10:
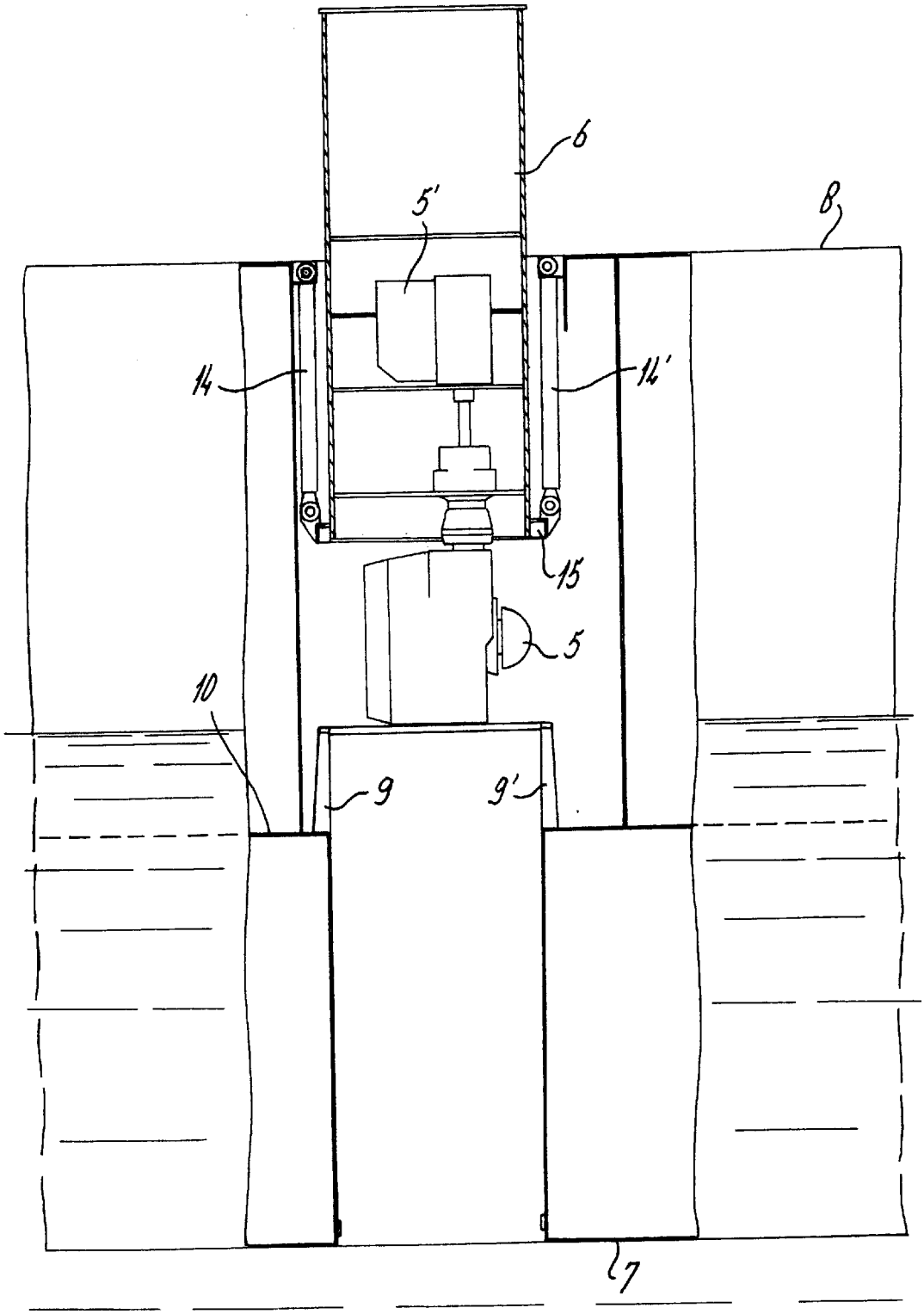
FIG. 10 shows the thruster of FIG. 6 in the second stage of retraction for inspection or maintenance purposes.
Figure 13:
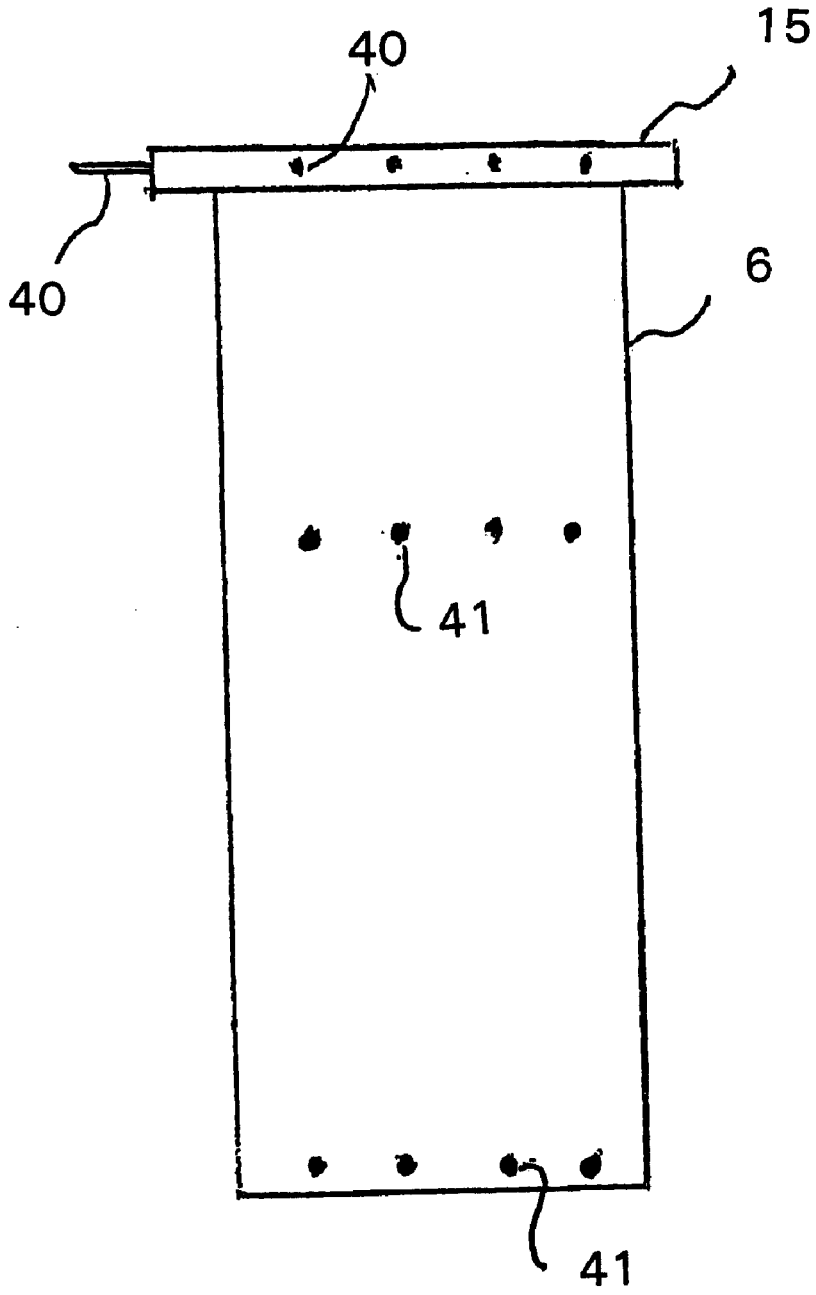
FIG. 13 shows the exterior of the frame according to FIG. 6.

FIG. 6 shows an embodiment wherein the lifting means of the thruster 5 are formed by hydraulic cylinders 14,14'. As illustrated in FIG. 13, the frame 6 of the thruster 5 is mounted in a ring 15 and is connected thereto by means of separate connection pins or bolts 40 and holes 41 in the frame 6. When the cylinders 14, 14' are completely retracted as shown in FIG. 7, the thruster 5 is located at keel level 7. For further lifting the thruster, the ring 15 is disconnected from the frame 6 and is slid along said frame by extending the cylinders 14,14' until the ring 15 abuts against the support members 9,9'. At the position shown in FIG. 8 the ring 15 is reattached to the frame 6 which is thereto provided with a second set of holes for connecting to the coupling pins of the ring 15. FIG. 9 shows a further retraction position of the thruster 5. In this position again the frame 6 is fixed relative to the vessel whereafter the ring 15 is disconnected from the frame 6 and slid to the lowest position of the frame 6 to be reattached in that position. Thereafter the cylinders 14,14' are retracted for the last time so that the frame 6 comes to extend above deck level 8, as shown in FIG. 10. The lifting system is designed to be able to lift the thruster which above water level, including the weight of the container or frame 6, has a weight of about 100 tons.

FIGS. 11 and 12 show the lockig device 30, which is integrated with the pinion drive 4, in the locked and unlocked positions, respectively. The locking pin 31 is via a lever 32 displaceable from and towards the rack 3, and can be entered into a hole or recess 3*a* in the rack 3. The electric drive motor of the pinion drive 4 is mounted in the same housing as the locking pin 31. On the housing, a first arm 33 and a second arm 34 are hingingly connected. The first arm 33 can be moved by means of a spindle 36, which engages a threaded bush 37 at the end of the arm 33. The spindle 36 may be manually operated, for instance by means of a hand wheel, By raising the arm 33, the arm 34 is pressed with its end into engagement with a curved pressing surface 35 of the rack 3, such that the lockig device 30 is pressed downward with respect of the rack 3. As the frame 6 carrying the thruster 5, has buoyancy, and is preferably formed as a closed container, the downward force exerted by the looking device 30 eliminates any play in the suspension of the frame within the shaft 2.

What is claimed is:

1. Vessel provided with a retractable thruster (5) that is mounted in a frame (6) which is displaceable in a shaft (2) in the hull of the vessel, which frame (6) is connected to a lifting device (3, 3'; 4, 4'; 12) for retracting the thruster in two stages, the lifting device in the first stage lifting the thruster to a level at or near the keel (7) of the vessel, the second stage comprising lifting the thruster (5) to an access level, located above the first level, characterised in that the shaft (2) of the vessel is provided with a rack (3, 3'), the lifting device comprising a pinion (4, 4') movable along the rack (3, 3'), the pinion (4, 4') being connected to the frame (6), wherein in the second stage the rack (3, 3') can be extended by means of a separate rack extension means (12) which is attachable to the rack (3, 3').

2. Vessel according to claim 1, characterised in that, the rack extension means (12) is attachable to connecting means on the vessel.

3. Vessel provided with a retractable thruster (5) the thruster being mounted in a frame (6) which is displaceable in a shaft (2) in the hull of the vessel, which frame (6) is connected to a lifting device (14, 14', 15) for retracting the thruster in two stages, the lifting device in the first stage lifting the thruster to a level at or near the keel (7) of the a vessel, the second stage comprising lifting the thruster (5) to an access level, located above the first level characterised in that, the lifting device (14, 14', 15) is placed in a fixed position, substantially below deck level the frame (6) being attached to the lifting device in a detachable manner via first coupling members, the frame comprising further coupling member connectable to the lifting device and located closer to the thruster than the first coupling members.

4. Vessel according to claim 3, characterised in that, the frame (6) is supported in a support element (15) that can be displaced along the frame (6) towards and away from the thruster (5), the support element being connectable to a first set of coupling holes in the frame (6) and to a second set of coupling holes by means of coupling pins.

5. Vessel according to claim 4, characterised in that, the support element is a ring (15) wherein the frame is suspended.

6. Vessel according to claim 3, characterised in that, the lifting device comprises hydraulic cylinders (14, 14').

7. Vessel according to claim 1, characterised in that the frame (6) comprises a container, having buoyancy.

8. Vessel according to claim 7, characterised in that the frame (6) is provided with a locking element (30) comprising a displaceable pin (31) which can be placed into a recess or hole (3*a*) in the rack (3), and a pushing member (34) which can be engaged with the hull of the vessel to exert a downward pushing force on the frame (6).

9. Vessel according to claim 1, characterised in that the frame (6) is provided with a radial rim (11) which can be engaged with a supporting surface (22) on the hull of the vessel to suspend the frame (6) in its lowermost position, the supporting surface (22) carrying a flexible sealing element (23).

10. Vessel according to claim 1, characterised in that the inner wall of the shaft (2) in which the frame (6) is vertically displaceable, is above keel level provided with a flexible sealing element (16) or a sealing projection (17, 18), the frame being provided with spaced apart, radially extending, upper and lower complementary sealing devices (17, 18) for engaging with the sealing element (16) or sealing projection on the inner wall, the lower sealing device contacting the sealing element or sealing projection in the first stage of retraction, the upper sealing device (17) contacting the sealing element (16) or sealing projection in the lowermost position of the frame.

11. Vessel according to claim 3, characterized in that the frame (6) comprises a container, having buoyancy.

12. Vessel according to claim 3, characterized in that the frame (6) is provided with a radial rim (11) which can be engaged with a supporting surface (22) on the hull of the vessel to suspend the frame (6) in its lowermost position, the supporting surface (22) carrying a flexible sealing element (23).

13. Vessel according to claim 3, characterized in that the inner wall of the shaft (2) in which the frame (6) is vertically displaceable, is above keel level provided with a flexible sealing element (16) or a sealing projection (17, 18), the frame being provided with spaced apart, radially extending, upper and lower complementary sealing devices (17, 18) for engaging with the sealing sealing element (16) or sealing projection on the inner wall, the lower sealing device contacting the sealing element or sealing projection in the first stage of retraction, the upper sealing device (17) contacting the sealing element (16) or sealing projection in the lowermost position of the frame.

* * * * *